United States Patent [19]

Hwa et al.

[11] 4,101,441

[45] Jul. 18, 1978

[54] COMPOSITION AND METHOD OF INHIBITING CORROSION

[75] Inventors: Chih Ming Hwa, Palatine; Jose T. Jacob, Lake Zurich, both of Ill.

[73] Assignee: Chemed Corporation, Cincinnati, Ohio

[21] Appl. No.: 707,717

[22] Filed: Jul. 21, 1976

Related U.S. Application Data

[63] Continuation-in-part of Ser. No. 644,654, Dec. 29, 1975, abandoned, which is a continuation of Ser. No. 529,175, Dec. 3, 1974, abandoned.

[51] Int. Cl.[2] ..... C23F 11/16; C23F 11/14; C23F 11/18

[52] U.S. Cl. ..... 252/389 A; 21/2.5 A; 21/2.7 A; 106/14.12; 210/58; 252/8.55 E; 252/181; 252/387

[58] Field of Search ..... 252/389 A, 387, 8.55 E, 252/180, 181; 106/14; 210/58; 21/2.5 A, 2.7 A

[56] References Cited

U.S. PATENT DOCUMENTS

| | | | |
|---|---|---|---|
| 3,679,592 | 7/1972 | Schomburg | 252/180 |
| 3,714,066 | 1/1973 | King et al. | 252/389 A |
| 3,723,333 | 3/1973 | Freyhold | 21/2.7 A |
| 3,751,372 | 8/1973 | Zecher | 21/2.7 A |
| 3,803,047 | 4/1974 | Hwa | 252/389 A |
| 3,837,803 | 9/1974 | Carter et al. | 252/389 A |
| 3,935,125 | 1/1976 | Jacob | 252/389 A |

*Primary Examiner*—Benjamin R. Padgett
*Assistant Examiner*—Irwin Gluck
*Attorney, Agent, or Firm*—Charles L. Harness

[57] ABSTRACT

The invention disclosed provides a new composition and method for inhibiting corrosion. The present composition is relatively non-toxic, contains no chromates, and consists essentially of an azole, water-soluble phosphate and water-soluble organophosphonic acid. Effective amounts of the corrosion inhibiting composition are used to provide corrosion protection in both ferrous and non-ferrous metals.

4 Claims, No Drawings

COMPOSITION AND METHOD OF INHIBITING CORROSION

This application is a continuation-in-part of Ser. No. 644,654, filed Dec. 29, 1975, now abandoned, which is in turn a continuation of Ser. No. 529,175, filed Dec. 3, 1974, now abandoned.

This invention relates to a method and composition for preventing corrosion of metal surfaces in contact with aqueous systems.

Water-soluble inorganic chromates are widely used to treat industrial water systems to prevent corrosion of metal parts. When these chromates are employed alone, they are used in concentrations as low as 200 ppm. and as high as 10,000 ppm., depending upon the protection needed and the permissible cost. When these chromates are used in combinations with molecularly dehydrated inorganic phosphates such as disclosed in U.S. Pat. No. 2,711,391, chromate concentrations as low as 20 ppm. have been found adequate in mild corrosive systems. Therefore, combinations of chromates and molecularly dehydrated phosphates are widely used.

Although chromates are highly effective corrosion inhibitors, their use is subject to several difficulties. Chromates cause serious skin and eye irritations, and chromates cannot be used in aqueous systems such as cooling towers or air-wash units where the resulting spray will contact people. Chromate solutions, because they are toxic, often require chemical treatment before being discharged to waste systems. Furthermore, chromates degrade organic compounds mixed therewith, limiting the types of organic compounds which can be mixed with the chromates in dry mixtures and aqueous solutions.

Azole compounds have also been employed in compositions designed to control corrosion. However, azole compounds have been used only in copper alloy systems since it has been widely recognized that azole compounds are ineffective in protecting ferrous metals from corrosion.

For these reasons, use of chromates and azole compounds in preventing ferrous metal corrosion has not been entirely satisfactory.

It has now been found, however, that by practice of the present invention there is provided a new method and composition using an azole, water-soluble phosphate, and water-soluble organophosphonic acid in combination to effectively control corrosion in both ferrous and non-ferrous systems while overcoming the disadvantages associated with chromate-containing compositions.

Generally stated, the corrosion inhibiting composition of this invention consists essentially of from 1 to 80 weight percent of an organophosphonic acid having one of the following formulae A, B, or C:

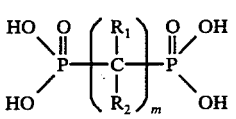

Formula A or

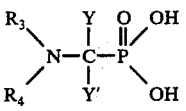

Formula B or

-continued

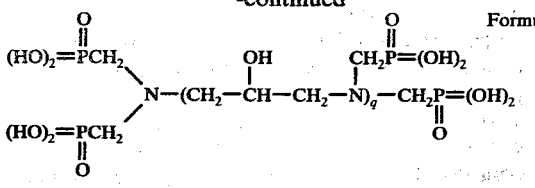

Formula C wherein $m$ is an integer from 1 to 10; $R_1$ is hydrogen, or an alkyl group having from 1 to 4 carbons; $R_2$ is hydroxyl, amino, hydrogen, or an alkyl group having from 1 to 4 carbons; $R_3$ is a member selected from the group consisting of hydrogen, hydroxyl, hydroxy alkyl groups containing from 1 to 4 carbon atoms, aliphatic groups containing from 1 to 30 carbon atoms, and

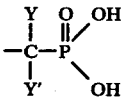

$R_4$ is a member selected from the group consisting of hydrogen, aliphatic groups containing from 1 to 30 carbon atoms,

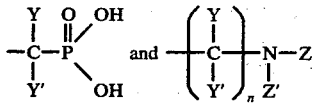

wherein $n$ is an integer from 1 to 30; Y and Y' are members selected from the group consisting of hydrogen and lower alkyl groups containing from 1 to 4 carbon atoms; Z is a member selected from the group consisting of hydrogen and

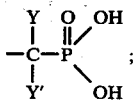

and Z' is a member selected from the group consisting of hydrogen,

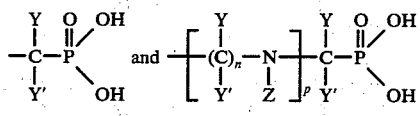

wherein $p$ is an integer from 1 to 30; with at least one of the groups represented by $R_3$ and $R_4$ containing at least one

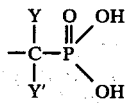

group; $q$ is an integer from 1 to 10; and the water-soluble salts and esters thereof; or mixtures thereof; and from 1 to 80 weight percent of an azole compound selected from a group consisting of triazoles, pyrazoles, imidazoles, isoxazoles, oxazoles, isothiazoles, thiazoles and mixtures thereof, and from 0.1 to 95 weight percent of a water-soluble phosphate. Aqueous solutions of 1 to 70 weight percent of this composition are also encompassed within this invention.

The method of this invention for preventing corrosion of metals in contact with an aqueous liquid comprises maintaining in the aqueous liquid from 0.1 to 50,000 ppm. of the organophosphonic acid, salts or esters thereof, and from 0.1 to 50,000 ppm. of azole compound and from 0.1 to 50,000 ppm. of a water-soluble phosphate.

The process of this invention is useful with a wide variety of aqueous systems, that is, any corrosive aqueous system in contact with metal surfaces. Suitable systems which can be treated according to this invention include cooling towers, water circulating systems, and the like wherein fresh water, brines, sea water, sewage effluents, industrial waste waters, and the like are circulated in contact with metal surfaces. These compounds are useful in radiator coolers, hydraulic liquids, antifreezes, heat transfer mediums, and petroleum well treatments. Pickling and metal cleaning baths can also be treated according to the process and composition of this invention. The process of this invention is suitable for reducing the corrosion of iron, copper, aluminum, zinc, and alloys containing these metals which are in contact with the corrosive aqueous system.

The composition of this invention is a stable corrosion inhibiting composition. Concentrations in the composition are stated as weight percents, and concentrations in the aqueous systems treated are stated as parts per million unless otherwise specified.

The compositions of this invention contain from 1 to 80 percent of an organophosphonic acid compound. The preferred organophosphonic acid compound for use in the composition of this invention is an alkylene diphosphonic acid having the foregoing Formula A, such as those disclosed in U.S. Pat. Nos. 3,214,454 and 3,297,578, the entire disclosures of which are incorporated herein by reference. Also suitable is an organophosphonic acid having the foregoing Formula B such as those disclosed in U.S. Pat. No. 3,298,956, the entire disclosure of which is incorporated herein by reference. Suitable acids of this type include methylenediphosphonic acid; ethylidenediphosphonic acid; isopropylidenediphosphonic acid; 1-hydroxy, ethylidenediphosphonic acid; hexamethylenediphosphonic acid; trimethylenediphosphonic acid; decamethylenediphosphonic acid; 1-hydroxy, propylidenediphosphonic acid; 1,6-dihydroxy, 1,6-dimethyl, hexamethylenediphosphonic acid; 1,4-dihydroxyl, 1,4-diethyl, tetramethylenediphosphonic acid; 1,3-dihydroxy 1,3-dipropyl, trimethylenediphosphonic acid; 1,4-dibutyl, tetramethylenediphosphonic acid; dihydroxy, diethyl, ethylenediphosphonic acid; 4-hydroxy, 6-ethyl, hexamethylenediphosphonic acid; 1-hydroxy, butylidenediphosphonic acid; butylidenediphosphonic acid; 1-aminoethane-1,1-diphosphonic acid; 1-aminopropane-1,1-diphosphonic acid; 1-aminoethane-1,1-diphosphonic acid monoethyl ester, amino tri(methyl phosphonic acid), amino tri(ethylidene phosphonic acid), amino tri(isopropylidene phosphonic acid), amino tri(butylidene phosphonic acid), amino tri(isopentylidene phosphonic acid), ethylene diamine tetra(methyl phosphonic acid), ethylene diamine tri(methyl phosphonic acid), ethylene diamine di(methyl phosphonic acid), hexamethylene diamine tetra(methyl phosphonic acid), diethylene triamine penta(methyl phosphonic acid), N-(2-hydroxy-ethyl) nitrilo N,N-di(methyl phosphonic acid), and 2-hydroxy propylene 1,3-diamine tetra(methyl phosphonic acid). The water-soluble salts of these acids such as the alkali metal, alkaline earth metal, zinc, cobalt, lead, tin, nickel, ammonium, or amine and lower alkanol amine salts can be used. Also, esters of these acids with an aliphatic alcohol having from 1 to 4 carbons, or mixtures of the above acids, salts or esters can be used. Use of mixtures of any of the general types of organophosphonic acid compounds described above is also contemplated within the scope of this invention.

The compositions of this invention also contain from 1 to 80 percent and preferably from 15 to 50 percent of an azole compound. Azoles are nitrogen containing heterocyclic 5-membered ring compounds. Azoles which are suitable in the composition of this invention include triazoles, pyrazoles, imidazoles, isoxazoles, oxazoles, isothiazoles, thiazoles and mixtures thereof as disclosed in U.S. Pat. Nos. 2,618,608, 2,742,369, and 2,941,953.

The triazoles which can be employed in the composition of this invention are water-soluble 1,2,3-triazoles such as 1,2,3-triazole itself or a substitute 1,2,3-triazole where the substitution takes place in either the 4 or 5 position (or both) of the triazole ring as shown here by the structural formula:

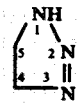

Suitable triazoles include benzotriazole (the preferred triazole); 4-phenyl-1,2,3-triazole; 1,2-naphthotriazole and 4-nitrobenzotriazole; and the like.

The pyrazoles which can be used in the composition of this invention include water-soluble pyrazoles such as pyrazole itself or a substituted pyrazole where the substitution takes place in the 3,4, or 5 position (or several of these positions) of the pyrazole ring as shown by the structural formula:

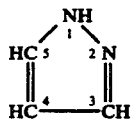

Suitable pyrazoles include pyrazole; 3,5-dimethyl pyrazole; 6-nitroindazole; 4-benzyl pyrazole; 4,5-dimethyl pyrazole; and 3-allyl pyrazole; and the like.

Imidazoles which can be used in the composition of this invention include water-soluble imidazoles such as imidazole itself or a substituted imidazole where the substitution takes place in the 2,4 or 5 position (or several of these positions) of the imidazole ring as shown here by the structural formula:

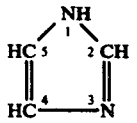

Suitable imidazoles which can be employed in the composition of this invention include imidazole; adenine; quanine; benzimidazole; 5-methyl benzimidazole; 2-phenyl imidazole; 2-benzyl imidazole; 4-allyl imidazole; 4-(betahydroxy ethyl)-imidazole; purine; 4-methyl imidazole; xanthine; hypoxanthene; 2-methyl imidazole; and the like.

Isoxazoles which can be employed in the composition of this invention include water-soluble isoxazoles such as isoxazole itself or a substituted isoxazole where the substitution takes place in the 3,4 or 5 position (or several of these positions) of the isoxazole ring as shown here by the structural formula:

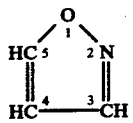

Suitable isoxazoles include isoxazole; 3-mercaptoisoxazole; 3-mercaptobenzisoxazole; benzisoxazole; and the like.

The oxazoles which can be employed in the composition of this invention include water-soluble oxazoles such as oxazole itself or a substituted oxazole where the substitution takes place in the 2,4 or 5 position (or several of these positions) of the oxazole ring as shown here by the structural formula:

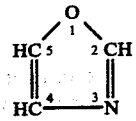

Suitable oxazoles include oxazole; 2-mercaptoxazole; 2-mercaptobenzoxazole; and the like.

The isothiazoles which can be employed in the process of this invention include water-soluble isothiazoles such as isothiazole itself or a substituted isothiazole where the substitution takes place in either the 3,4 or 5 position (or several of these positions) of the isothiazole ring as shown here by the structural formula:

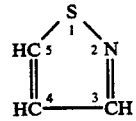

Suitable isothiazoles include isothiazole; 3-mercaptoisothiazole; 3-mercaptobenzisothiazole; benzisothiazole; and the like.

The thiazoles which can be used in the composition of this invention include water-soluble thiazoles such as thiazole itself or a substituted thiazole where the substitution takes place in the 2,4 or 5 position (or several of these positions) of the thiazole ring as shown here by the structural formula:

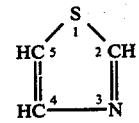

Suitable thiazoles include thiazole; 2-mercaptothiazole; 2-mercaptobenzothiazole; benzothiazole; and the like.

In the above azole compounds, the constituents substituted in the azole rings can be alkyl, aryl, aralkyl, alkylol, and alkenyl radicals so long as the substituted azole is water-soluble. Typically, substituted members have from 1 to about 12 carbon atoms.

Water-soluble phosphate which may be used herein includes materials such as phosphoric acid, disodium phosphate, sodium tripolyphosphate, tetrapotassium pyrophosphate and the like.

The composition of this invention can also contain dispersing agents, pH regulating agents, microbicides, and the like.

The treatment compositions employed in the process of this invention can be added to the water by conventional bypass feeders using briquettes containing the treatment, by adding the compounds either separately or together as dry powder mixtures to the water, or it can be fed as an aqueous feed solution containing the treatment components.

The organic phosphorous acid compounds employed in the composition and process of this invention exhibit unexpected stability in briquettes and solutions. Furthermore, substantially no degradation of the organic phosphorous acid components to orthophosphates occurs in the feed compositions and systems treated.

The compositions of this invention are non-toxic and prevent corrosion of metals in contact with aqueous liquids. These compositions can be substituted for chromate base corrosion inhibitors previously used where the toxicity of the chromate makes its use undesirable or where disposal of corrosion inhibiting solutions containing chromates raises serious water pollution problems requiring extensive pretreatment to remove the chromates prior to disposal of such solutions. The compositions of this invention in aqueous solutions prevent corrosion of metal parts such as heat exchangers, engine jackets, and pipes and particularly prevent metal loss, pitting, and tuberculation of iron base alloys, copper alloys, and aluminum alloys in contact with water.

The invention is further illustrated by the following specific but non-limiting examples.

EXAMPLE 1

This example demonstrates the synergistic reduction in corrosion rate obtained with the composition of this invention.

In this test, circulating water having the following composition was used.

Calcium sulfate dihydrate: 714 ppm
Magnesium sulfate heptahydrate: 519 ppm
Sodium bicarbonate: 185 ppm
Sodium chloride: 989 ppm During the test, the circulating water was fed to a closed circulating test system at a rate of 5 gallons per day, the overflow from the test system being discharged to waste.

In the closed circulating system, circulating water having a temperature of 130° F. and a pH of 7.5 – 8.0 was fed at a rate of one gallon per minute to a coupon chamber containing test coupons for the corrosion test. Water from the coupon chamber was then passed through an arsenical admiralty brass tube for a scaling test; the tube was surrounded by a jacket through which a heating fluid having an initial temperature of 240° F. was counter-currently passed. The circulating water was then cooled to 130° F. and recirculated through the system. The total circulating time for each test was 10 days.

Mild steel, brass (33 wt. percent zinc), and copper coupons having an average area of 26.2 cm.$^2$ were used in the test chamber. The coupons were carefully cleaned and weighed before use. Following the test, each coupon was cleaned with inhibited hydrochloric acid, rinsed, dried and weighed to determine the corrosion rate in mils per year.

Following each test the admiralty brass tube was removed; scale from representative areas of the tube interior was removed and weighed to determine the weight gain per unit area due to scaling.

The results obtained are shown in Table A.

TABLE A

| Ex. No. | Additive | Corrosion Rate in Mils per year Steel | Copper | Brass |
|---|---|---|---|---|
| 1 | Blank (No treatment) | 19.6 | 1.1 | 1.7 |
| 2 | Mercaptobenzothiazole (I) 10 ppm | 19.2 | 0.2 | 0.2 |
| 3 | Benzotriazole (II) 10 ppm | 24.5 | 0.3 | 0.2 |
| 4 | Phosphoric acid (III) 3 ppm | 20.2 | 0.56 | 0.36 |
| 5 | Hexamethylenediamine tetra (methylphosphonic acid (IV) 3.1 ppm | 35.8 | 0.76 | 1.32 |
| 6 | I 5 ppm, III 3 ppm, IV 3.1 ppm | 3.9 | 0.18 | 0.29 |
| 7 | I 5 ppm, III 3 ppm, Ethylenediamine tetra(methylphosphonic acid) 3.1 ppm | 3.0 | 0.17 | 0.25 |
| 8 | I 5 ppm, III 3 ppm, N-(2-hydroxyethyl) nitrilo N,N-di(methylphosphonic acid) 6.2 ppm | 3.5 | 0.21 | 0.24 |
| 9 | I 5 ppm, III 3 ppm, 2-Hydroxypropylene 1,3-diamine tetra(methylphosphonic acid) 3.1 ppm | 4.5 | 0.17 | 0.29 |
| 10 | I 5 ppm, III 3 ppm, amino tri-(methylphosphonic acid) 3.1 ppm | 5.9 | 0.27 | 0.34 |
| 11 | I 5 ppm, III 4.2 ppm, 1-Hydroxy ethylidene diphosphonic acid (V) 6 ppm | 5.6 | 0.31 | 0.32 |
| 12 | I 5 ppm, III 3 ppm, V 3.1 ppm | 4.6 | 0.09 | 0.13 |
| 13 | I 6.6 ppm, III 4.5 ppm, IV 4.7 ppm | 1.7 | 0.15 | 0.22 |
| 14 | II 5 ppm, III 10.7 ppm, V 6 ppm | 3.6 | 0.27 | 0.41 |
| 15 | III 3 ppm, V 3.1 ppm | 17.3 | 0.90 | 0.70 |

The advantage of having an azole compound is evident by comparing Example No. 12 with Example No. 15. As shown in Table A, a synergistic corrosion rate reduction was observed with each of the metals tested when the circulating water was treated according to this invention. The combination of compounds was better than would be expected from the results obtained using the compounds alone. Furthermore, synergistic scale reduction was also observed.

The following compositions according to this invention show similar unexpected corrosion reductions when tested by the procedure described in Example 1.

| Example No. | Ingredients - Weight % |
|---|---|
| 16 | Benzotriazole 35%, disodium phosphate 25%, pentasodium salt of amino tri(methyl phosphonic acid) 40%. |
| 17 | Mercaptobenzothiazole 40%, tetrapotassium pyrophosphate 20%, tripotassium salt of 1-hydroxy ethylidene diphosphonic acid 40%. |
| 18 | Mercaptobenzothiazole 75%, sodium tripolyphosphate 2%, amino tri (isopropylidene phosphonic acid) 23%. |
| 19 | Imidazole 5%, dipotassium phosphate 10%, diethylene triamine penta(methyl phosphonic acid) 85%. |

-continued

| Example No. | Ingredients - Weight % |
|---|---|
| 20 | Benzotriazole 45%, monosodium phosphate 20%, disodium salt of trimethylene diphosphonic acid 35%. |
| 21 | Isoxazole 15%, tetrasodium pyrophosphate 70%, pentapotassium salt of 2-hydroxy propylene 1,3-diamine tetra(methyl phosphonic acid) 15%. |
| 22 | 2-Mercaptothiazole 60%, monoammonium phosphate 5%, methylene diphosphonic acid 35%. |
| 23 | Water 80%, benzotriazole 1%, phosphoric acid 6%, 1-hydroxy ethylidene diphosphonic acid 13%. |
| 24 | Water 85%, sodium mercaptobenzothiazole 4%, sodium tripolyphosphate 4%, tetrapotassium salt of 1-hydroxy propylidene diphosphonic acid 7%. |
| 25 | Water 70%, benzotriazole 0.8%, phosphoric acid 15%, 1-aminopropane-1,1-diphosphonic acid 14.2%. |
| 26 | Pyrazole 20%, monopotassium phosphate 25%, pentasodium salt of amino tri(methyl phosphonic acid) 55%. |

Obviously many modifications and variations of the invention as hereinabove set forth can be made without departing from the essence and scope thereof, and only such limitations should be made as are indicated in the claims.

What is claimed is:

1. A non-chromate-containing corrosion inhibiting composition which consists essentially of 1 to 80 weight percent azole, 0.1 to 98 weight percent water-soluble phosphate and 1 to 85 weight percent of water-soluble organophosphonic acid, water-soluble salts and esters thereof, said azole being a member of the group consisting of triazoles, pyrazoles, imidazoles, isoxazoles, oxazoles, isothiazoles, thiazoles, and mixtures thereof, said water soluble phosphate being selected from the group consisting of phosphoric acid, disodium phosphate, dipotassium phosphate, sodium tripolyphosphate, tetrapotassium pyrophosphate and tetrasodium pyrophosphate, and said organophosphonic acid having the formula

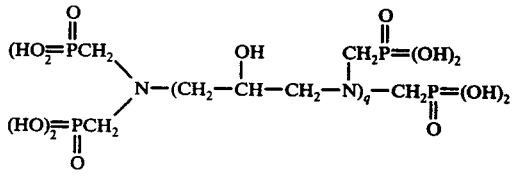

in which $q = 1 - 10$.

2. The composition of claim 1 disposed in 1 to 70 weight percent water.

3. The composition of claim 1 wherein the azole is present in an amount of 15 to 50 weight percent.

4. A method for preventing corrosion of metals in contact with an aqueous liquid comprising maintaining in the aqueous liquid from 0.1 to 50,000 ppm. of the composition of claim 1.

* * * * *